US009082247B2

(12) United States Patent
Turner et al.

(10) Patent No.: US 9,082,247 B2
(45) Date of Patent: Jul. 14, 2015

(54) AUTOMATED COLLECTION POINT

(75) Inventors: Daniel Turner, Wantage (GB); Fabien Pichet, Sable sur Sarthe (FR); Philippe Michel, Sable sur Sarthe (FR)

(73) Assignee: BYBOX HOLDINGS LIMITED, Wantage, Oxfordshire (GB)

( * ) Notice: Subject to any disclaimer, the term of this patent is extended or adjusted under 35 U.S.C. 154(b) by 366 days.

(21) Appl. No.: 13/498,740

(22) PCT Filed: Sep. 28, 2010

(86) PCT No.: PCT/GB2010/051615

§ 371 (c)(1), (2), (4) Date: Mar. 28, 2012

(87) PCT Pub. No.: WO2011/036498

PCT Pub. Date: Mar. 31, 2011

(65) Prior Publication Data

US 2012/0194043 A1 Aug. 2, 2012

(30) Foreign Application Priority Data

Sep. 28, 2009 (GB) ..... 0916970.7

(51) Int. Cl.
*B60R 25/00* (2013.01)
*G05B 19/00* (2006.01)
(Continued)

(52) U.S. Cl.
CPC ..... *G07F 7/00* (2013.01); *Y10T 70/5097* (2015.04)

(58) Field of Classification Search
CPC ..... G07F 17/12; G07F 7/00; A47G 29/141; E05Y 2900/132; Y10T 70/5097; E05B 65/0075; E05B 47/00; E05B 47/0001; E05B 47/0005; E05G 1/04; E05G 1/06; E05G 1/08; G06Q 10/0836
USPC ..... 235/382; 340/5.72, 545.6, 545.1, 340/568.13, 5.73
See application file for complete search history.

(56) References Cited

U.S. PATENT DOCUMENTS 3,653,154 A * 4/1972 Hayday ..... 49/280
3,860,994 A 1/1975 Itoda et al.
(Continued)

FOREIGN PATENT DOCUMENTS

DE 2323876 11/1974
DE 4103396 * 8/1991
(Continued)

OTHER PUBLICATIONS

Machine translation, DE 2323876 acessed from espace.net, Oct. 18, 2014.*
(Continued)

*Primary Examiner* — Daniel J Troy
*Assistant Examiner* — Kimberley S Wright
(74) *Attorney, Agent, or Firm* — Fay Sharpe LLP

(57) ABSTRACT

A modular automated collection point (ACP) comprises an array of electronically controlled lockers for receiving items for sale or for delivery to customers, a controller and user interface, a parcel weighing and dimensional measuring unit, and a package deposit unit with a one-way door for depositing items for subsequent delivery to other customers or ACPs. Each door preferably moves rapidly from the fully-open position to a partially-open position, and then slowly from the partially-open position towards a fully-closed position. Each locker may comprise a retractable handle and an elongate, rotating closure element which moves the locker door between the fully-closed (locked) position and a nearly-closed (unlocked) position. Preferably the closure element has a cylindrical outer wall which conforms slidingly to the fascia of the lockerbank so as to present a seamless appearance and prevent prising.

12 Claims, 6 Drawing Sheets

(51) Int. Cl.

| | |
|---|---|
| ***G05B 23/00*** | (2006.01) |
| ***G06F 7/00*** | (2006.01) |
| ***G06F 7/04*** | (2006.01) |
| ***G08B 29/00*** | (2006.01) |
| ***G08C 19/00*** | (2006.01) |
| ***H04B 1/00*** | (2006.01) |
| ***H04B 3/00*** | (2006.01) |
| ***H04Q 1/00*** | (2006.01) |
| ***H04Q 9/00*** | (2006.01) |
| ***G07F 7/00*** | (2006.01) |

(56) References Cited

U.S. PATENT DOCUMENTS

| | | | | | |
|---|---|---|---|---|---|
| 4,064,589 | A | * | 12/1977 | Bejarano et al. | 16/53 |
| 4,669,394 | A | * | 6/1987 | Fogleman et al. | 109/59 T |
| 4,836,352 | A | * | 6/1989 | Tateno et al. | 194/215 |
| 4,857,714 | A | * | 8/1989 | Sunyich | 235/382 |
| 4,894,717 | A | * | 1/1990 | Komei | 348/150 |
| 5,169,222 | A | * | 12/1992 | Bollore et al. | 312/328 |
| 5,223,829 | A | * | 6/1993 | Watabe | 340/5.73 |
| 5,231,272 | A | * | 7/1993 | Mardon | 235/382 |
| 5,233,343 | A | * | 8/1993 | Mazzoni | 340/5.33 |
| 5,386,462 | A | * | 1/1995 | Schlamp | 379/93.12 |
| 5,474,342 | A | * | 12/1995 | Smith et al. | 292/254 |
| 5,475,378 | A | * | 12/1995 | Kaarsoo et al. | 340/5.6 |
| 5,531,498 | A | * | 7/1996 | Kowall | 296/146.4 |
| 5,575,515 | A | * | 11/1996 | Iwamoto et al. | 292/341.17 |
| 5,657,511 | A | | 8/1997 | Lan | |
| 5,687,507 | A | | 11/1997 | Beran | |
| 5,831,220 | A | * | 11/1998 | Ramsden et al. | 177/1 |
| 5,894,277 | A | * | 4/1999 | Keskin et al. | 340/5.21 |
| 6,259,352 | B1 | * | 7/2001 | Yulkowski et al. | 340/5.7 |
| 6,323,782 | B1 | * | 11/2001 | Stephens et al. | 340/10.31 |
| 6,532,399 | B2 | * | 3/2003 | Mase | 700/237 |
| 6,685,284 | B2 | * | 2/2004 | Hara | 312/215 |
| 6,690,997 | B2 | * | 2/2004 | Rivalto | 700/237 |
| 6,715,682 | B2 | * | 4/2004 | Hara | 235/462.14 |
| 6,791,450 | B2 | * | 9/2004 | Gokcebay et al. | 340/5.73 |
| 6,806,807 | B2 | * | 10/2004 | Cayne et al. | 340/5.52 |
| 6,899,268 | B2 | * | 5/2005 | Hara | 235/382 |
| 6,961,711 | B1 | * | 11/2005 | Chee | 705/26.1 |
| 6,999,825 | B2 | * | 2/2006 | Inomata | 700/90 |
| 7,089,770 | B2 | * | 8/2006 | Ramsauer et al. | 70/208 |
| 7,129,817 | B2 | * | 10/2006 | Yamagishi | 340/5.53 |
| 7,249,705 | B2 | * | 7/2007 | Dudley | 232/47 |
| 7,295,110 | B2 | * | 11/2007 | Mercier et al. | 340/545.6 |
| 7,445,255 | B2 | * | 11/2008 | Nye-Hingston et al. | 292/144 |
| 7,484,333 | B2 | * | 2/2009 | Houser et al. | 49/506 |
| 7,681,424 | B2 | * | 3/2010 | Antonucci | 70/208 |
| 7,760,069 | B2 | * | 7/2010 | Cayne et al. | 340/5.22 |
| 7,891,138 | B2 | * | 2/2011 | Ottino | 49/503 |
| 8,854,180 | B2 | * | 10/2014 | Bacarella | 340/5.6 |
| 8,854,184 | B2 | * | 10/2014 | Mullin et al. | 340/5.81 |
| 2001/0025883 | A1 | * | 10/2001 | Ichihara et al. | 235/381 |
| 2001/0045449 | A1 | * | 11/2001 | Shannon | 232/19 |
| 2004/0021551 | A1 | * | 2/2004 | Yamagishi | 340/5.52 |
| 2004/0158351 | A1 | | 8/2004 | Rivalto | |
| 2006/0254144 | A1 | * | 11/2006 | Ottino | 49/279 |
| 2006/0255905 | A1 | * | 11/2006 | Cayne et al. | 340/5.22 |
| 2007/0267489 | A1 | * | 11/2007 | Borodulin | 235/382 |
| 2008/0105012 | A1 | * | 5/2008 | Poppell | 70/279.1 |
| 2012/0086314 | A1 | * | 4/2012 | Bourke et al. | 312/109 |
| 2012/0187811 | A1 | * | 7/2012 | Kim et al. | 312/228 |
| 2013/0261792 | A1 | * | 10/2013 | Gupta et al. | 700/232 |
| 2014/0300117 | A1 | * | 10/2014 | Scheffler et al. | 292/336.3 |

FOREIGN PATENT DOCUMENTS

| | | | | | |
|---|---|---|---|---|---|
| DE | 10304262 | A1 | * | 8/2004 | B65G 37/02 |
| EP | 2006225853 | | | 8/2006 | |
| EP | 1 713 034 | A1 | | 10/2006 | |
| GB | 2 275 302 | A | | 8/1994 | |
| GB | 2 437 967 | A | | 11/2007 | |
| JP | 2009185522 | A | | 8/2009 | |
| WO | WO01/31827 | A2 | | 5/2001 | |
| WO | WO 01/58603 | A1 | | 8/2001 | |
| WO | WO 02/07021 | A2 | | 1/2002 | |
| WO | WO 2008/104731 | A2 | | 9/2008 | |
| WO | WO 2008104731 | A2 | * | 9/2008 | A47B 87/02 |
| WO | WO2009/148388 | A1 | | 12/2009 | |

OTHER PUBLICATIONS

International Search Report, Mar. 22, 2011.
Written Opinion, Mar. 22, 2011.
Great Britain Search Report, GB0916970.7, Jan. 14, 2010.
Great Britain Search Report, GB1016277.4, Jan. 28, 2011.
GB Search Report, Application No. GB1202659.7, Date of Search Jun. 29, 2012.

* cited by examiner

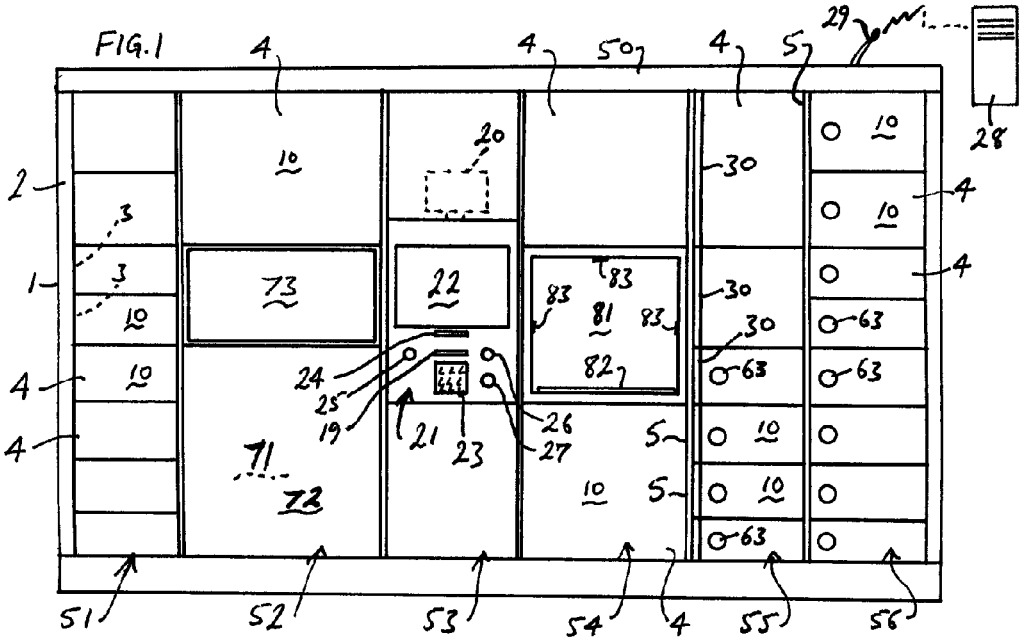
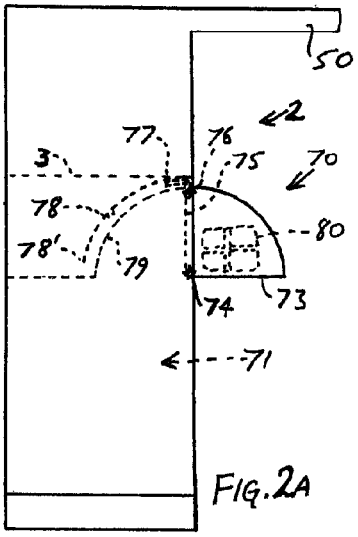
FIG.2A
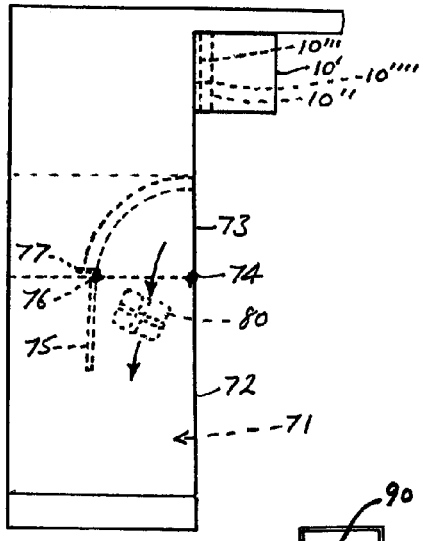
FIG.2B
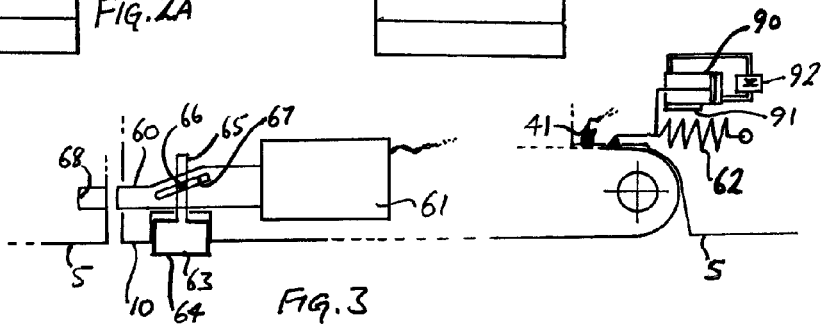
FIG.3

FIG. 4A
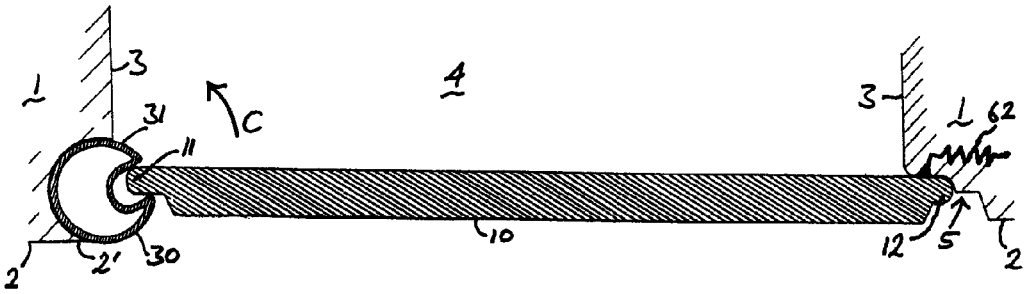
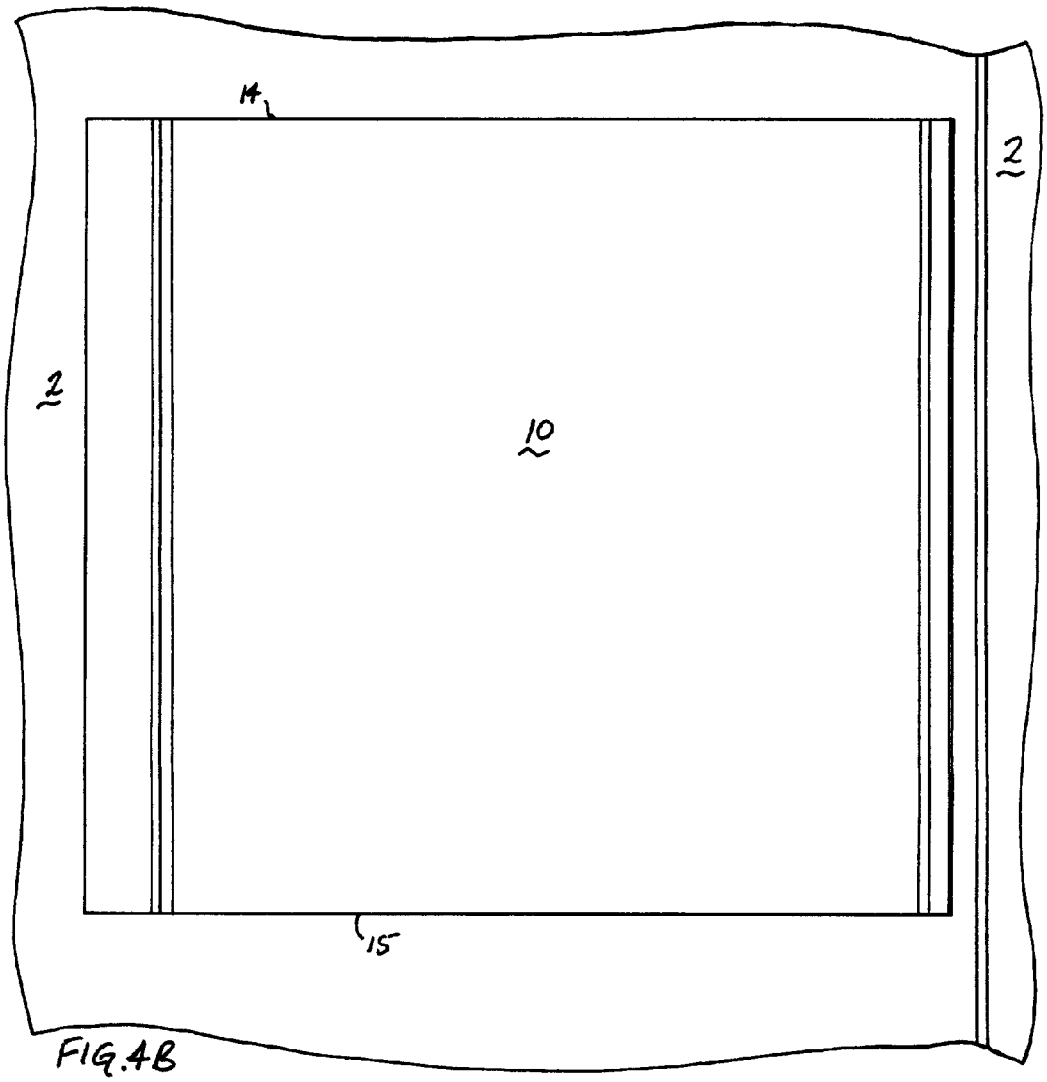
FIG. 4B

FIG. 5A
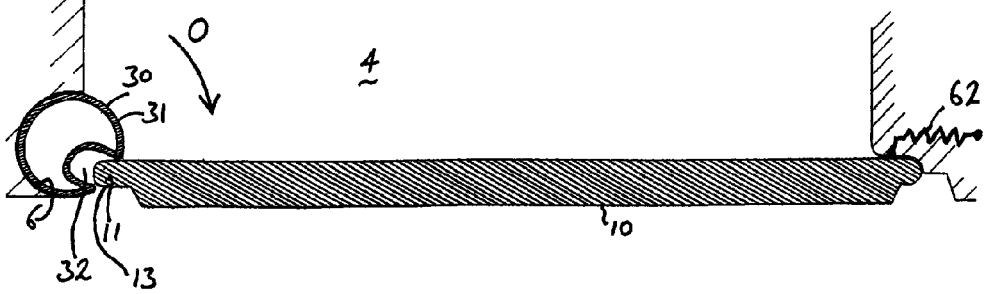
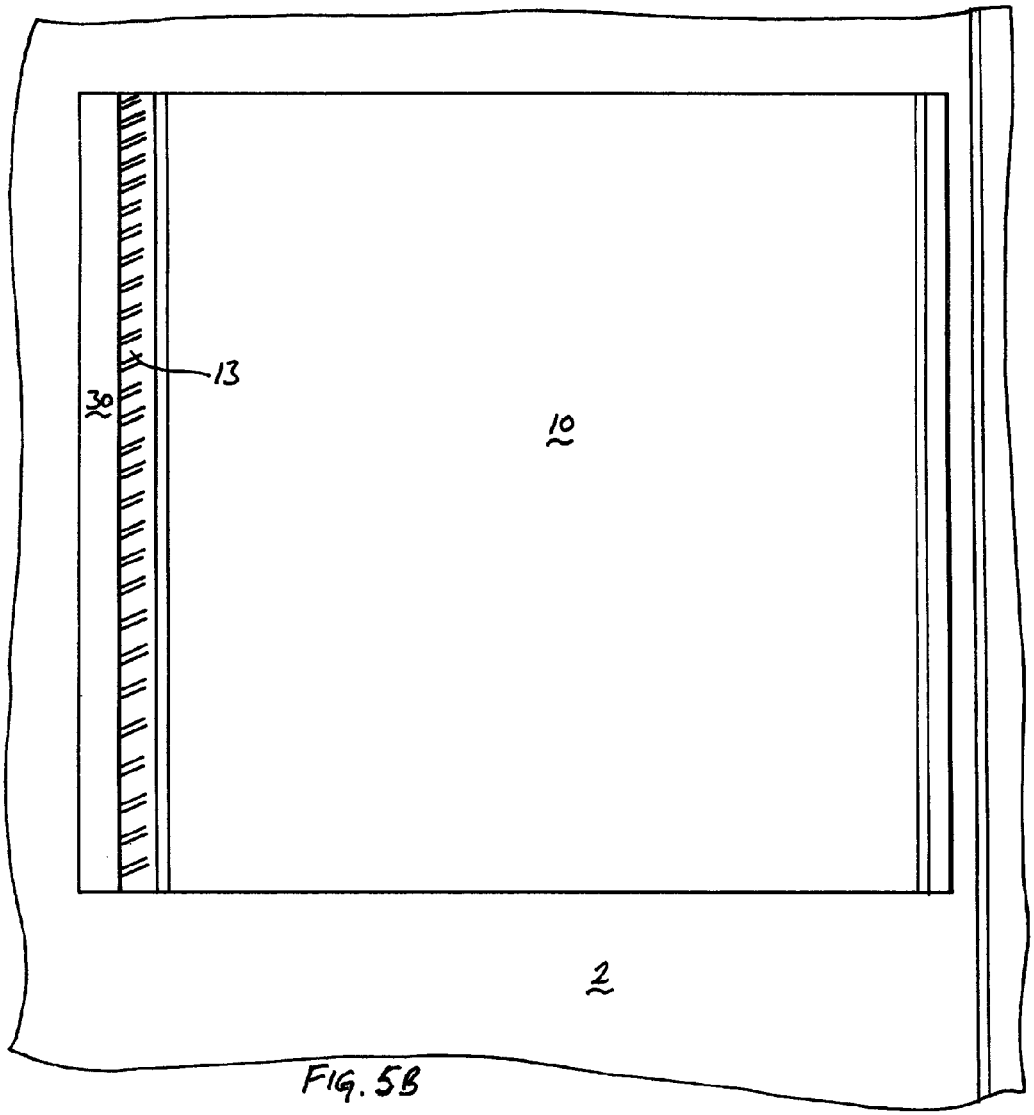
FIG. 5B

FIG. 6A
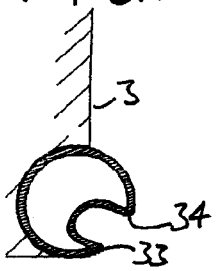
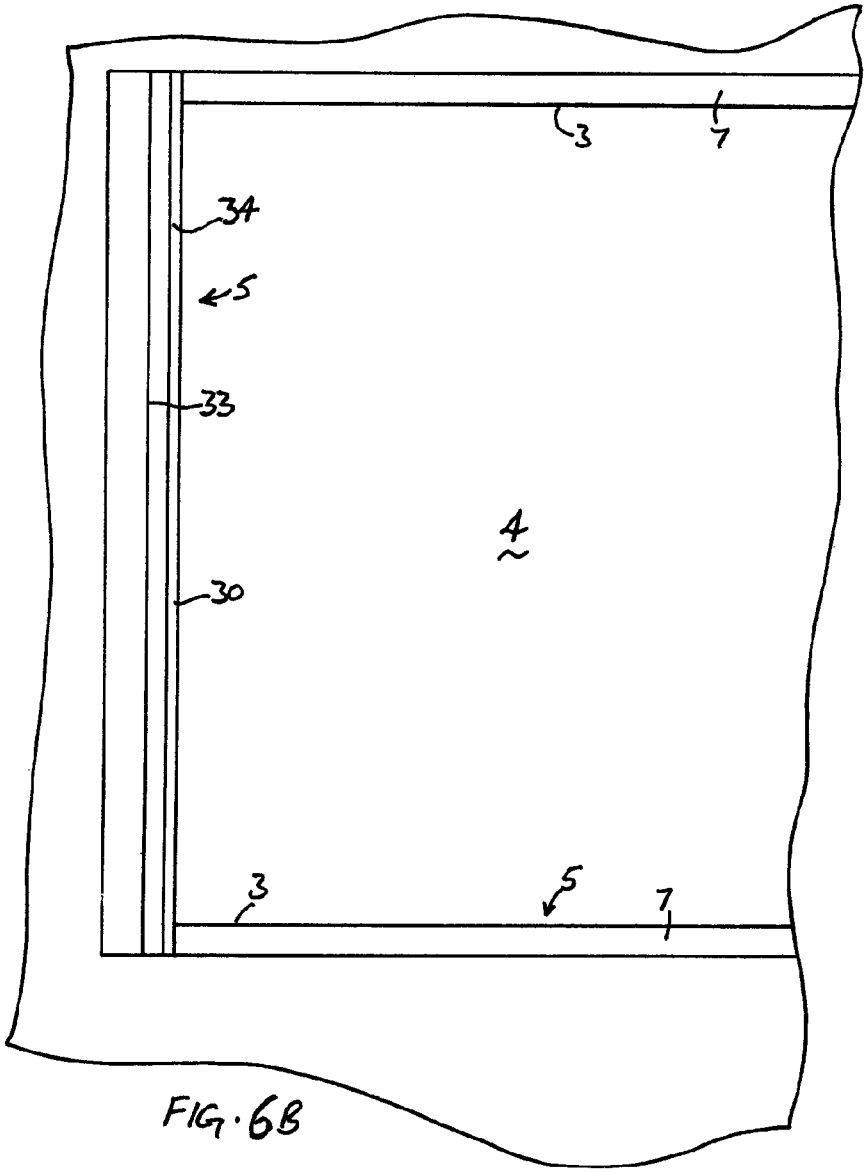
FIG. 6B
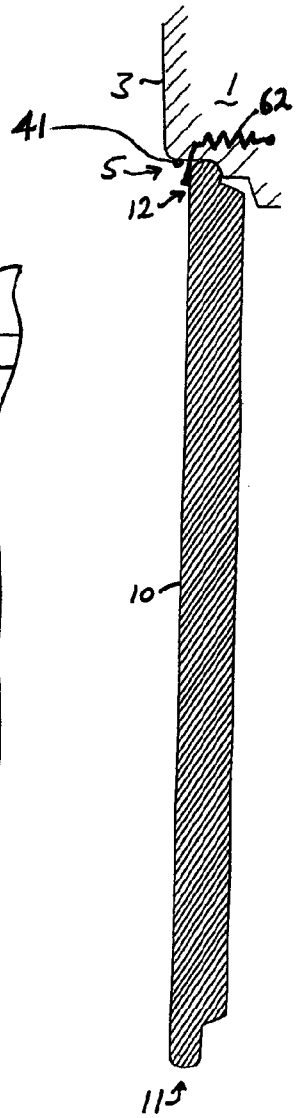

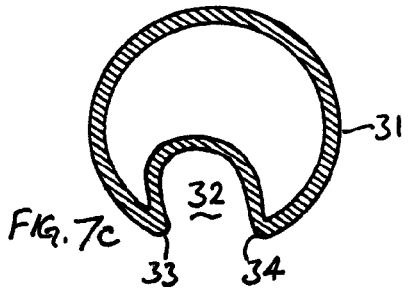
FIG. 7C
FIG. 7A
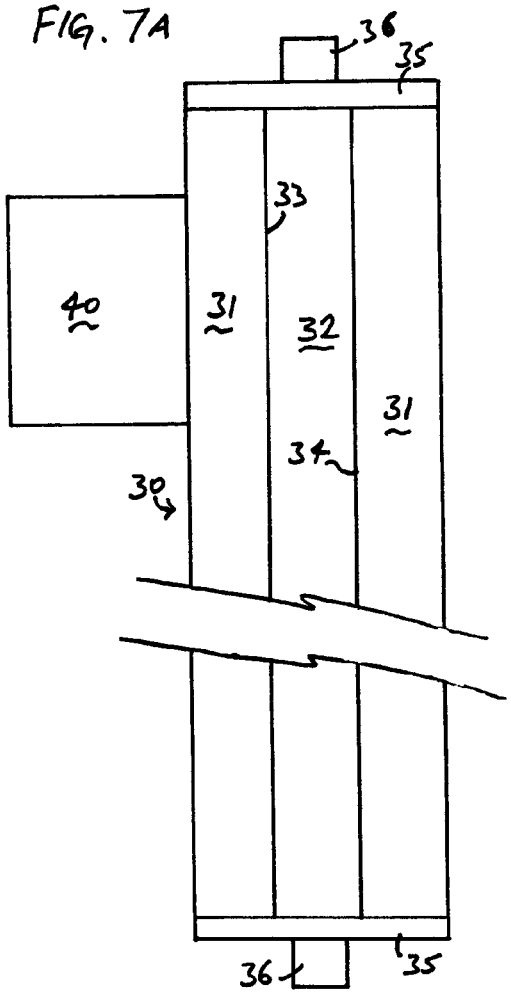
FIG. 7B
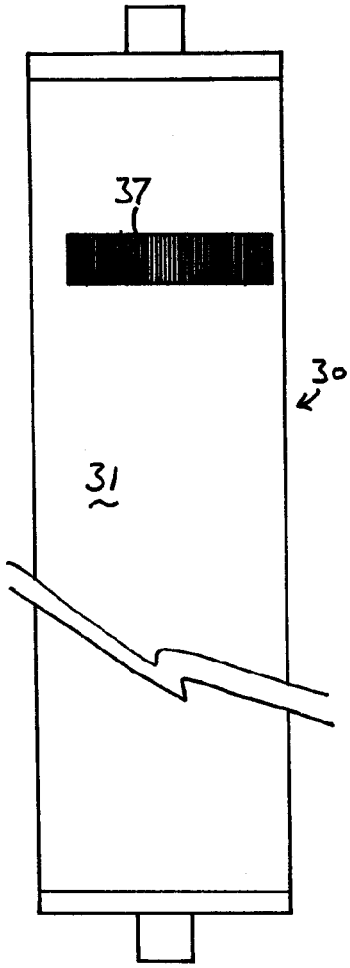
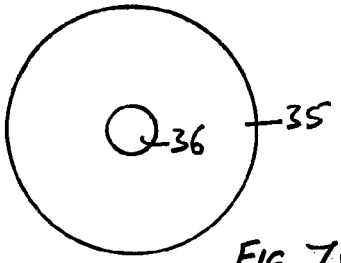
FIG. 7D

AUTOMATED COLLECTION POINT

CROSS-REFERENCE TO RELATED APPLICATIONS

This application is a 371 National Stage Entry of International application number PCT/GB2010/051615, having an international filing date of Sep. 28, 2010, which was published in English, and which claims priority to Great Britain Patent Application No. GB 0916970.7, filed Sep. 28, 2009, the entirety of which are hereby incorporated by reference as if fully set forth herein.

This invention relates to automated collection points (hereinafter "ACPs"), which are banks of electronically controlled lockers (lockerbanks) in which goods are deposited by delivery service personnel for later collection by the addressee.

Automated collection points are known for example from WO02/07021 A2 to the present applicant. An ACP typically comprises an electronic controller which is in communication with a remote computer, a user interface including a keypad and a card or tag reader, and a block of secure lockers, each having an individual door. The controller locks and unlocks each locker door in response to data received via the interface.

As well as being used for the reception and temporary storage of goods for collection by the addressee, ACPs can incorporate other functionality and in particular can also be used to dispatch goods for collection and subsequent delivery by delivery service personnel. For example, U.S. Pat. No. 4,836,352 provides a bank of electronically controlled lockers in which each locker includes a weight sensor for determining the weight of the parcel deposited therein, and a user interface at which the user inputs the name and address details of the addressee and pays the delivery fee, which is calculated by reference to the weight of the package deposited in the locker and/or the size of the package, determined by the size of the locker in which it is placed.

It is of course important for each locker to be reasonably secure against attempts to prise it open, and to resist deformation which would render it unusable. It is also important that each locker door should be as far as possible under automatic control, while minimising the risk of a lockerbank user or, for example, a small child or animal becoming entrapped in the locker or injured by a door closing or locking mechanism. At the same time, each locker and its associated mechanism should preferably be as simple, robust and inexpensive as possible. Advantageously, each locker door can move automatically to a partially open (ajar) position as soon as it is unlocked, so as to provide a visual indication to the user that the locker is available. It is further desirable for the door when locked to be substantially sealed so as to protect the contents of the locker from the weather.

Lockerbank doors have traditionally been locked by means of two or more solenoid operated deadbolts, which are moved automatically to the locking position when sensors indicate that the door is fully closed. The bolts are set apart so as to lock the door at two or more spaced positions, which adds considerably to its security and rigidity in the closed position. The door is spring biased to the partially open (ajar) position so that it pops open when the bolts are retracted. In order for the door to be relocked, the user must first push it shut from the ajar position against the biasing force. By arranging a resilient seal along the door jamb the locker door may be made weathertight; however, the effectiveness of the seal depends in part on the force applied to compress it, which in turn is limited to the force supplied by the user.

It is desirable to ensure that as many lockers as possible are available to receive deliveries. In the system of WO02/07021 A2, a locker door not shut within 30 seconds after it is opened will be left unlocked until the next delivery is made. This ensures that small children or animals cannot be inadvertently trapped in the locker, but temporarily removes the locker from service and leaves it vulnerable to vandalism and to the ingress of rainwater, animals and so forth.

It is a general object of the present invention to overcome or mitigate at least some of the above mentioned problems. In some embodiments it is a particular object to provide an automated collection and delivery system comprising an automated collection point which offers additional functionality while maximising the availability of its component lockers.

In accordance with its various aspects the present invention provides an automated collection and delivery system, an automated collection point and methods of operation as defined in the claims.

Some illustrative embodiments will now be described, purely by way of example and without limitation to the scope of the invention, and with reference to the accompanying drawings, in which:

FIG. 1 is a front view of an ACP in accordance with a first embodiment;

FIGS. 2A and 2B are left end views of the ACP of FIG. 1, showing the package deposit mechanism in respectively the open and closed state;

FIG. 3 is a schematic drawing of the button retraction mechanism of one locker door;

FIGS. 4A and 4B are respectively cross sectional and front views of part of the first ACP, showing the door and doorframe of a first one of its component lockers, with the door in the fully-closed position;

FIGS. 5A and 5B are views corresponding to FIGS. 4A and 4B showing the door in the nearly-closed (ajar) position;

FIGS. 6A and 6B are views corresponding to FIGS. 4A and 4B showing the door in the fully-open position;

FIG. 7A is a front side view of the closure element and actuator of the first locker;

FIGS. 7B, 7C and 7D are respectively rear side, cross sectional and end views of the closure element of FIG. 7A.

Corresponding features are indicated by the same reference numerals in each of the figures.

Figure 8B:
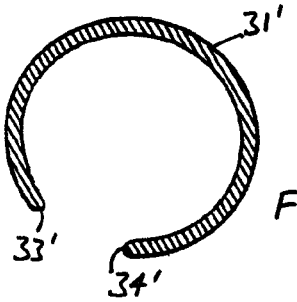
FIGS. 8A, 8B and 8C are respectively side, cross sectional and end views of a second closure element according to an alternative embodiment.

Referring to FIG. 1, a first ACP comprises a plurality of interchangeable columnar modules 51, 52, 53, 54, 55, 56 which are protected by a canopy 50 and linked together mechanically to define a secure outer body shell or carcass 1 including a vertical front wall or fascia 2 and internal walls 3 which define a plurality of individual lockers 4, each locker having a door 10 which is received in a doorframe 5. All of the modules are interchangeable so the ACP can be expanded as necessary, e.g. by including additional columns, or by replacing any of the columns with columns of a different type. Its functional components can thus be added, removed and interchanged as required, providing operational flexibility.

Column 53 comprises a central console including a local electronic controller 20 cooperating with a local user interface 21, the user interface including a printer 19 for printing self-adhesive labels, a touchscreen 22, a keypad 23, a card reader 24, a contactless sensor and tag reader 25, a biometric (e.g. iris or fingerprint) scanner 26, and a barcode scanner 27. The ACP forms part of an automated collection and delivery system, which may be similar to that described in WO02/07021 A2, comprising a network of similar ACPs in different locations. The controller 20 of each ACP communicates via a radio link 29 with a remote computing system 28 having a database containing details of registered users of the system, which may include contact (telephone, email, home address, preferred ACP address) details and also credit and payment details for each user.

Each of columns 51, 55 and 56 comprises a plurality of lockers 4, each of the lockers having a door 10 with a lock operably coupled to the controller 20 for locking and unlocking the locker. The illustrated embodiment shows by way of example some lockers (columns 51, 56) having a conventional lock comprising one or more deadbolts 60, each actuated by a solenoid 61 (FIG. 3); and other lockers (column 55) having a lock comprising an elongate closure element 30 which is described in more detail below.

In use, a package for delivery to a user (comprising e.g. a delivery code which uniquely identifies the package and which is encoded as a barcode or RFID tag) is scanned at the interface 21, either directly or via a hand-portable scanner with bluetooth or other short-range wireless link to the interface. Once the barcode, RFID tag or other package details are verified by the controller, one of the lockers 4 is opened and the package is deposited inside, and the door 10 is shut and locked.

A collection code which uniquely identifies the package (for example, because it is stored in the remote computing system and/or in the local memory of the controller in association with the package details) may then be generated and sent to the addressee in any convenient way, e.g. via email or SMS message to the addressee's mobile telephone. At a convenient time, the addressee then visits the ACP and inputs via the user interface at least one of the collection code and a user code which identifies him as a registered user of the ACP network. The user code is a personal identifier and could be one or more of a chipped, magnetic or barcoded user ID card, the user's credit or debit card, a radio frequency ID (RFID) tag, a mobile telephone or other near field communication (NFC) enabled device containing an identity code, a code or personal identification number (PIN), a fingerprint, an iris scan, or any other coded or biometric identifier. The controller identifies the locker containing the package and unlocks the lock mechanism to allow access to the package.

As well as receiving packages for registered addressees, the ACP is advantageously configured to allow registered users as depositors to deposit packages for delivery to other registered or non-registered users as addressees, and to allow non-registered users as depositors to deposit packages for delivery to other registered users as addressees, as will now be described.

Referring also to FIGS. 2A and 2B, column 52 includes a one-way package deposit mechanism 70, which is configured to permit a plurality of packages to be deposited one by one into a common package deposit enclosure 71 (containing a large bag or box into which the deposited packages fall) while simultaneously preventing the removal at the same time via the mechanism of the packages so deposited. The enclosure 71 is emptied by delivery service personnel via a large door 72. The mechanism 70 comprises an outer door 73 which is pivoted outwardly about a pair of pivots 74 to form a shelf on which the package 80 is placed. An inner door 75 is pivotably connected to the outer door 73 at a pair of pivots 76. A short lever 77 extends in fixed relation from the inner door 75 at each respective pivot 76 and engages a track 78 on either side of a fixed internal wall 79, the levers 77, tracks 78 and wall 79 being curved about the axis of pivots 74. As the outer door 73 is opened, each lever 77 engages the end 78' of its respective track and is urged into alignment with the track, rotating the inner door 75 into the closed position relative to the outer door 73 (FIG. 2A), in which position it may be locked to the outer door by a solenoid bolt (not shown). As the outer door is closed, the inner door 75 remains in its closed position relative to the outer door until the levers 77 reach the ends 78' of the tracks, at which point they rotate as the inner door 73 drops down into the open position (FIG. 2B), allowing the package 80 to drop into the enclosure 71. The package 80 cannot thereafter be removed via the deposit mechanism 70, but only via the door 72.

More than one enclosure 71 may be provided, with corresponding compartments defined between the outer and inner doors of the deposit mechanism, so that small and large parcel flows can be separated. Alternative one-way deposit mechanisms may be employed as well known in the art. By storing all deposited (outgoing) packages in the same enclosure, more efficient operation is obtained since all the lockers 4 remain available to accept packages for collection or items for sale, as described below.

The package deposit mechanism is controlled by the controller 20, which is arranged to prevent the deposit of a package via the package deposit mechanism unless dispatch details identifying at least one registered user of the system as the depositor or addressee of the package are entered into the interface. The identification could be the user code of the depositor, or a code or PIN number or mobile telephone number or email address identifying the addressee, and/or his or her name and address. The user details can be verified in real time via the remote computing system, or alternatively and more preferably, the ACP can verify the user details by reference to a local database stored in the controller and updated asynchronously from the remote computing system. This ensures that the ACP can continue to operate even when communication is temporarily interrupted, but cannot be abused by individuals who do not possess the appropriate identification.

The controller 20 then generates dispatch indicia (including for example a package identification number generated by the controller and details of the addressee corresponding to the dispatch details entered into the interface), which are printed out on a self-adhesive label by the printer 19. Conveniently, the label is attached to the package by the user, although alternatively a label applicator may be incorporated in the deposit mechanism or measuring unit. The user may then scan the package bearing the label at the central console. The controller 20 then unlocks the door 73 to permit the deposit of the package 80. The label may include a barcode or RFID or other readable code, and a sensor in the deposit mechanism may sense the presence of the label and cooperate with the controller to prevent the deposit of any package that is not labelled correctly.

Column 54 comprises a package measuring unit 81 which communicates with the controller 20 and which is adapted to measure at least one parameter of the package 80. Preferably the unit 81 comprises a weighing platform 82 for measuring the weight of the package and sensors 83 for sensing the dimensions of the package, both of which parameters may be used by the controller to calculate the delivery charge. Suitable units are available from ExpressCube™ of Mississauga, Ontario, Canada. The measuring unit is configured as shown as an aperture which permits the user to insert the package 80 into the measuring unit and then remove the package from the measuring unit, and the controller is configured to unlock the door 73 when at least the measured parameter is received from the measuring unit. The controller may be arranged to prevent the deposit of the package unless payment for the package is received via the user interface (e.g. by inserting a credit card into the card reader and entering the PIN via the keypad) or confirmed via the remote computing system, e.g. by looking up the user's account details to determine whether enough credit is available; the account lookup may be asynchronous, i.e. performed periodically with the user's credit status being updated each time in the local memory of the controller. Alternatively, the depositor may be given the option to charge the delivery to the addressee, which may be contingent on the addressee being a registered user of the system, in which case the addressee may pay for the package when he collects it from another ACP of the system.

Referring particularly to FIG. 2B and FIG. 3, each locker 4 has a door 10 with a closing mechanism (represented schematically by tension spring 62), the closing mechanism being configured to move the door rapidly (preferably in a few seconds) in a first phase of movement from a fully-open position (10') to a partially-open position (10") and then to move the door slowly (over a time period of, e.g., from 15 seconds to 5 minutes, preferably about 30 seconds to about 2 minutes) in a second phase of movement from the partially-open position to a fully-closed position (10""), and to allow the door to be re-opened at any point between the fully-open position and the fully-closed position, e.g. to allow removal of a trapped item of clothing. When the door reaches the fully-closed position it is locked, after which it cannot be re-opened until the controller unlocks it, e.g. on verifying a correct PIN and/or delivery or collection code entered via the interface.

Closing of the door may be accomplished for example by biasing the door towards the fully-closed position by means of a spring, such as a mechanical spring, a gas spring or the like; by gravity, e.g. using rising butt hinges, a weighted lever, or the like; or by means of a mechanism actuated by a motor or solenoid or the like. The rapid and slow phases of movement may be accomplished for example by providing free movement from the fully-open position to the partially-open position, and a retarded closing mechanism which engages the door only in the partially-open position. Alternatively, the biasing spring or other element may act against a dashpot or other retarding mechanism which defines two different speeds of travel; where a fluid dashpot 90 is used (FIG. 3), a fluid bypass passage 91 may be positioned so as to allow the piston to travel more quickly between the fully-open and partially-open positions than between the partially-open and fully-closed positions, and a one-way valve 92 may allow the door to be freely opened.

The lock is arranged to lock the door when it reaches the fully-closed position, e.g. either being actuated by the controller when a sensor senses the door has closed, or being latched mechanically by the closing edge of the door.

Advantageously, this prevents animals or children from becoming entrapped in the locker, but avoids the problem of the user forgetting to close the locker, and so ensures that the locker remains available to receive further deliveries.

Referring to FIG. 3, the door 10 of each locker in column 56 and of each of the smaller lockers in column 55 is provided with a handle 63 which is arranged to retract when the door is locked and to extend when the door is unlocked. This may be achieved by a mechanical linkage between the handle and the lock, for example as shown schematically in FIG. 3, with the handle having a stem 65 with a pin 66 which is slidably engaged in an angled slot 67 in the deadbolt. When the door position sensor 41 sends a signal to the controller 20 indicating that the door 10 is in the fully-closed position, the controller 20 energises the solenoid 61 which extends the deadbolt, and the pin 66 retracts the handle as the deadbolt enters the recess 68 in the doorframe. Alternatively for example, separate actuators could be provided for the lock and the handle, or the handle could be retracted by a lever which contacts the doorframe as the door is closed. In the retracted position an outer surface 64 of the handle is flush with an outer surface of the door 10. The handle functions to indicate to the user that the locker is available, but advantageously provides no point of leverage for an attack when the door is locked.

Instead of a conventional deadbolt mechanism, an elongate closure element 30 may be integrated into the fascia of the lockerbank so as to form the abutting edge of the doorframe which receives the opening edge (i.e. the thin side portion) of the door. It is thus possible to engage its opening edge continuously along its full vertical length without protruding from the door or into the front opening of the locker. This prevents prising and rigidifies the locked door without requiring expensive structural reinforcement. Alternatively the closure element may be concealed behind the door in its closed position.

An actuator may retain the closure element in the locked position, so locking the door, as well as moving the door from the fully-closed to the nearly-closed position, indicating the availability of the locker, and/or drawing it closed again without the intervention of the user.

By providing this relatively small range of automated movement, it is possible to provide a predetermined sealing force which can effectively compress a resilient seal so as to weatherproof the locker, while ensuring that the door does not begin to close under power until its opening edge is partially received into the doorframe. This obviates the risk of the user being injured by the closing door, and makes it less likely that an animal or small child can become trapped inside the locker.

Referring to FIGS. 4A and 4B, each doorframe 5 in the fifth column 55 is formed on its upper, lower and right hand sides by a stepped portion of the fascia or carcass, and at its left hand side by a lock comprising an elongate closure element 30 which is rotatably mounted in a corresponding recess 6 in the carcass 1. The closure element 30 has a smoothly curved, cylindrical outer wall 31 which is partially overlapped by a portion 2' of the fascia 2. Since the axis of rotation of the closure element lies in parallel with the opening edge 11 of the door and along the axis of its cylindrical outer wall, the outer wall 31 slidingly abuts the fascia 2 as the closure element rotates. The closure element is thus arranged to form an apparently seamless extension of the fascia 2 which defines the left hand edge of the doorframe.

Referring to FIGS. 4-6, the door 10 is hinged at its right hand edge 12 to the fixed doorframe 5 so that its opposite, left hand opening edge 11 can be freely moved by the user of the lockerbank away from the doorframe 5 and closure element 30 from the nearly-closed or ajar position (FIG. 5) to the fully-open position (FIG. 6). In the nearly-closed position the opening edge 11 of the door is received in an elongate cavity 32 which extends axially along the closure element 30. The mouth of the cavity 32 forms a gap in the cylindrical outer wall 31, defined by two continuous, parallel end faces 33, 34 of the outer wall 31 which form respectively first and second engaging surfaces.

The closure element 30 is rotated by an electrically powered actuator 40 (as further described below) which is remotely controlled by the central processor of the electronic lockerbank controller between a locked position, shown in FIG. 4, and an unlocked position, shown in FIGS. 5 and 6. In order to secure the locker 4, the door 10 is first moved by a closing mechanism such as a hinge spring 62 which provides a light biasing force from the fully-open position to the nearly-closed position as shown in FIG. 5, in which position its opening edge 11 rests against the second engaging surface 34.

Referring also to FIG. 2B, optionally, the closing mechanism may move the door in a first phase of movement at a first speed from the fully-open position (10') to the intermediate, partially-open position (10"), and then at a second, slower speed in a second phase of movement from the partially-open position (10") to the nearly-closed position (10'''). Preferably, the door travels substantially faster and substantially further between the fully-open position (10') and the partially-open position (10"), than between the partially-open position (10") and the nearly-closed position (10'''). The door thus moves fairly rapidly to the partially-open position, in which it is close enough to the doorframe to make it difficult for rain, animals and the like to get into the locker; and then continues to close fairly slowly for the remaining, much shorter distance from the partially-open position to the nearly-closed position. This gives the user a visual indication that the door is closing.

Rather than defining an abrupt change of speed when the door reaches the partially-open position, the speed of travel of the door may alternatively be smoothly and continuously reduced as it travels from the fully-open position via the partially-open position to the nearly-closed position, in which case the speed of movement of the door in its fast and slow phases is construed to mean its average speed in each respective phase.

The closing mechanism allows the door to be opened at any point during the first and second phases between the fully-open position and the nearly-closed position, which gives the user an opportunity to remove anything that has inadvertently been left in the locker or trapped by the closing door.

Referring particularly to FIG. 4A, when the door reaches the nearly-closed position (10''', FIG. 2B), a door position sensor 41 (visible in FIG. 6A), which can be a mechanical, electrical, optical, magnetic or any other type of sensor, then prompts the lockerbank controller to energise the actuator 40 which rotates the closure element 30 in the direction of the arrow C in a third phase of movement towards the locked position illustrated. As it rotates, the first engaging surface 33 slidingly and pressingly engages the outer face of the opening edge 11 of the door along substantially its whole vertical length between its upper 14 and lower 15 edges and draws the door into the fully-closed position (10'''', FIG. 2B) as illustrated in FIG. 4A. As it closes, resilient seals 7 (two of which can be seen in FIG. 6B) arranged around the doorframe are compressed by the predetermined force applied by the actuator to the door so as to provide a reliable, weathertight seal which also helps to keep a constant internal temperature and to contain any spillages from deposited goods. Additional seals may be arranged on suitable abutting surfaces (not shown) provided on the closure element 30 and internal walls 3, doorframe 5 or carcass 1. Once in the locked position, the continuous, unbroken vertical line of engagement between the first engaging surface 33 and door 10 makes it very difficult to prise the door open, and the cylindrical outer wall 31 gives the closure element 30 strength and rigidity without presenting any ledges or projections behind which a prising tool might be inserted.

Advantageously, there is no recess in the closing edge of the door, which is received progressively inside the cavity 32. Moreover, the cavity 32 is entirely occluded by the opening edge 11 of the door before the door can be engaged by the closure element. This virtually eliminates any possibility of finger entrapment before the third phase commences, which is an important consideration in an automatically operated mechanism for public use.

Referring to FIG. 5A, when the lockerbank controller determines that the locker door 10 is to be opened again, it energises the actuator 40 to rotate the closure element 30 in the reverse direction, shown by the arrow O. This causes the second engaging surface 34 to pressingly and slidingly engage the rear face of the opening edge 11 of the door and so urges the door to the nearly-closed (ajar) position as shown. In this position a high visibility strip 13 becomes visible to indicate to the user that the locker is available. The door 10 may then be grasped and pulled open by the user.

Referring to FIG. 7, the cylindrical wall 31 and cavity 32 of the closure element 30 are conveniently formed as an aluminium extrusion, welded to circular end plates 35 carrying bearings 36 by means of which the closure element is mounted in the carcass 1. A curved rack gear 37 is formed around part of the wall 31, or alternatively on the margin of one of the end plates 35, and is engaged by a worm gear (not shown) which is driven by an actuator comprising an electric motor 40 which is mounted behind the internal walls 3 of the locker and operably coupled to the central processor of the lockerbank controller. The motor may include an integral encoder or rotation sensor, and/or one or more position sensors may be fitted for sensing the position of the closure element and the door. The worm gear may be used to retain the closure element in the locked position, or alternatively a solenoid bolt or the like (not shown) may be arranged to engage the cylindrical wall 31 or an end plate 35 and so prevent the closure element from rotating.

The recess 6 which receives the closure element may be arranged with a peripheral wall which extends for more than 180 degrees so as to trap the cylindrical wall 31 and further enhance the security of the locker. The recess may be formed from two axial sections which are bolted together after insertion of the closure element, or alternatively the closure element may be inserted from one end of the recess before the column is assembled.

Figure 8A:
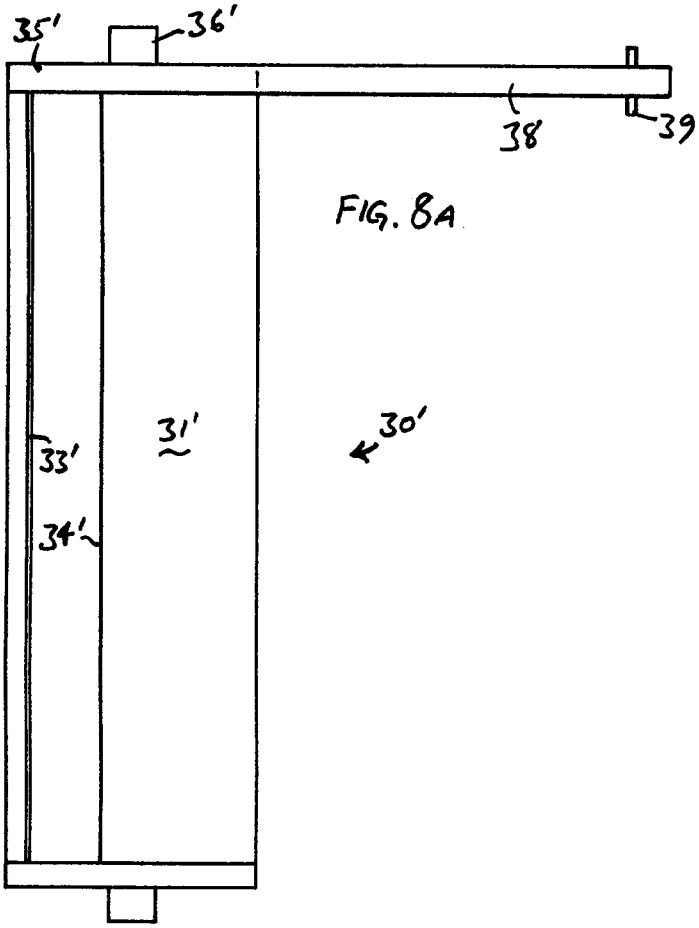
Figure 8C:
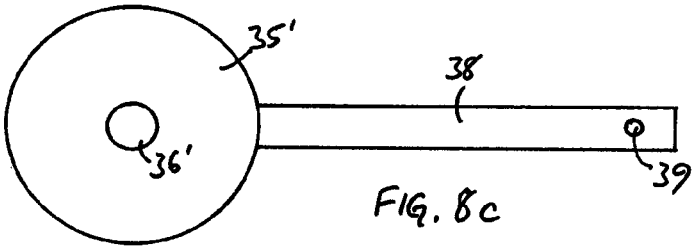

Referring to FIG. 8, in an alternative embodiment the closure element 30' is formed from a steel cylinder 31' which has an axial gap defined by the two parallel, axially elongate wall end surfaces 33', 34'. End plates 35' and bearings 36' are used to mount the closure element in the carcass 1, and one end plate is provided with a radially extending arm 38 having a pin 39 at its distal end. The arm is housed between the adjacent floor and ceiling of two vertically adjacent lockers, and a remotely controlled, electric or pneumatic actuator is linked to the pin 39 so as to rotate the closure element in response to control signals from the central controller in a similar way to that of the first embodiment.

In a yet further alternative embodiment, the actuator may be powered by a spring which is loaded by the movement of the door when it is opened or closed by the user. Movement of the actuator is remotely controlled by a solenoid bolt or ratchet mechanism which retains the spring in the loaded condition as the door is moved by the user, and is releasable by a signal from the electronic lockerbank controller to allow the spring to actuate the closure element.

It is also possible to arrange the closure element so that it allows the user to rotate it or to cause it to rotate in the reverse (opening) direction (e.g. by means of a slipping clutch or a force sensor operably coupled to the actuator) and thus open the door while the door is moving from the nearly-closed position to the fully-closed position; in which case the closing mechanism 62 may provide the first, fast phase of movement of the door from the fully-open position to the nearly-closed position, and the rotation of the closure element 30 may comprise the second, slow phase of movement of the door from the nearly-closed position to the fully-closed position.

The nearly-closed position thus corresponds to the partially-open position as described above, so there is then no need to define a partially-open position intermediate the nearly-closed and fully-open positions.

It will be noted that in the embodiment illustrated, the closure element is so dimensioned and positioned that the door is retained by the cavity of the closure element throughout its range of motion between the fully-closed position and the nearly-closed position. In alternative embodiments the mouth of the cavity may be widened so as to define a greater arc of rotation about its axis, in which case the door may be arranged to open freely from its fully-closed position when it is released by the closure element. Sensors may be arranged to determine the position of the door and the position of the closure element, so that the closure element may be arranged to release the door in its fully-closed position and then re-engage it in the nearly-closed position and draw it closed; or alternatively to urge it to the nearly-closed position after releasing it, but thereafter to allow it to be manually closed to the fully-closed position before re-engaging and locking it. The operation of the closure element may thus be adapted to whatever door management strategy is required by the application.

In the embodiments shown, the first and second engaging surfaces are continuous elements which extend for the full length of the opening edge of the door. In alternative, less preferred embodiments, one or both surfaces may be discontinuous, i.e. with gaps, and may extend for somewhat less than the whole length of the door. If desired, intermediate hinges or bearings may be spaced apart along the length of the closure element so as to more securely retain it to the carcass.

In alternative embodiments, the closure element may be mounted on the door rather than on the carcass or doorframe, in which case it is arranged to engage a suitably shaped part of the fixed doorframe which lies adjacent the opening edge of the door when the door is closed. The door may also be arranged to slide or be mounted on articulated arms or the like, in which case the closure element may be arranged to engage a flange or hook shaped protrusion or a recess arranged on the front or rear face of the door so as to exert a retaining force in the closing direction of the door. In less sophisticated embodiments the second engaging surface may be omitted, and the door may be biased instead away from the fully-closed position towards the nearly-closed position by a spring.

Whereas the closure element is preferably arranged to rotate about its central axis, so as to conform to the carcass as shown, in alternative embodiments it may be arranged to slide or be otherwise articulated without rotation. The opening edge of the door may include an elongate flange or protrusion, which may extend from the rear face of the door and which is engaged by the closure element, in which case the closure element may be hidden from view when the door is closed rather than forming the outer edge of the doorframe as shown in the illustrated embodiments.

A preferred method of operation of the ACP comprises the steps of a) delivering a first item to the automated collection point 1, wherein the first item is selected from the group consisting of an item for delivery to an addressee and an item for sale;
b) selecting and unlocking a first locker 50 from the plurality of lockers;
c) placing the first item in the first locker and locking the first locker;
d) receiving a request for the first item via the user interface 21 from a first user;
e) if the first item is an item for delivery to an addressee, if the request includes at least one of a collection code identifying the first item and a personal identification code identifying the addressee, unlocking the first locker 50, but otherwise not unlocking the first locker;
f) if the first item is an item for sale, if the request includes at least a payment for the first item, unlocking the first locker, but otherwise not unlocking the first locker.

Advantageously, the method allows each locker to be used, either to receive an item for an addressee, or to receive an item for sale, so that the ACP can be used also as a vending unit. Items for sale may be advertised on the touchscreen 22, for example, as a default display when no transaction is in progress. The user selects the item required by touching the display or via the keypad 23 and makes payment e.g. by credit or debit card via the card reader 24, or by deduction from an account of a user already registered with the ACP network, which may be replenished periodically via the user interface. The door 10 is then opened and the user collects the item. If more lockers are required to receive deliveries for addressees, then the locker 4 can be re-allocated to receive items for delivery to an addressee, maximising the number of lockers available to receive deliveries. In the embodiment shown, column 51 has been dedicated to use for items for sale, and column 55 has been dedicated for use for items for collection by specified addressees. However, the lockers 4 of both columns could be used interchangeably.

After an item is sold, a request is sent from the controller 20 via the remote computing system 28 for the delivery of another similar item for sale, which is deposited in the locker in the same way as an item for delivery to an addressee.

Advantageously, if an item is delivered for an addressee and one of the lockers 4 already contains an item for that addressee, then that locker is selected and unlocked to receive also the new item, so that the addressee can collect both items from the same locker, which frees up one locker for another delivery.

A further method of use comprises the steps of:

a) receiving a request from a first user for a dedicated locker;
b) assigning a first locker 4 from the plurality of lockers 4 for the exclusive use of the first user;
c) delivering a first item to the ACP, wherein the first item is an item for delivery to an addressee;
d) if the addressee is the first user, unlocking the first locker, placing the first item in the first locker and locking the first locker;
e) if the addressee is not the first user, selecting a second locker 4 from the plurality of lockers 4, unlocking the second locker, placing the first item in the second locker and locking the second locker.

Each locker 4 can thus be assigned to a specified user in the manner of a conventional post office box, so that the user always collects his deliveries from the same box. Once the user no longer requires the box, it can be re-allocated to receive deliveries for other users. It is also possible for a group of lockers to be reserved for use by a group of users, with each locker in the group of lockers being dynamically allocated to any user in the group as required to receive a delivery.

In summary, a modular automated collection point (ACP) comprises an array of electronically controlled lockers for receiving items for sale or for delivery to customers, a controller and user interface, a parcel weighing and dimensional measuring unit, and a package deposit unit with a one-way door for depositing items for subsequent delivery to other customers or ACPs. Each door preferably moves rapidly from the fully-open position to a partially-open position, and then slowly from the partially-open position towards a fully-closed position. Each locker may comprise a retractable handle and an elongate, rotating closure element which moves the locker door between the fully-closed (locked) position and a nearly-closed (unlocked) position. Preferably the closure element has a cylindrical outer wall which conforms slidingly to the fascia of the lockerbank so as to present a seamless appearance and prevent prising.

The various novel method and apparatus features of the ACP disclosed herein can be used individually in an otherwise conventional ACP, or in a stand-alone ACP or lockerbank without a remote computing system, or alternatively can be combined together in any desired combination.

Those skilled in the art will recognise that many adaptations may be made within the scope of the claims.

The invention claimed is:

1. An automated collection point including:
a plurality of lockers,
a local electronic controller,
and a local user interface cooperating with the controller,
each of the lockers having a door mounted in a doorframe,
a closing mechanism for moving the door from a fully-open position towards a fully-closed position,
and a lock controlled by the controller for locking and unlocking the door;
the door having an opening edge which is displaced away from the doorframe when the door is moved to the fully-open position and lies adjacent the doorframe when the door is in the fully-closed position,
the opening edge having a length;
wherein the closing mechanism is configured to move the door at a first speed in a first phase of movement from the fully-open position to a partially-open position, and then at a second, slower speed in a second phase of movement from the partially-open position to a nearly-closed position,
wherein the door is arranged to be re-openable by a user during both the first and second phases; and
wherein the lock comprises a closure element coupled to an actuator, the actuator being controlled by the controller, and the closure element is arranged to move the door in a third phase from the nearly-closed position to the fully-closed position, and to lock the door when it reaches the fully-closed position.

2. An automated collection point according to claim 1, wherein the closure element has an elongate first engaging surface which extends in parallel with the opening edge of the door and substantially along the length thereof in the fully-closed position,
the closure element being movable by the actuator between an unlocked position in which the door is free to move, and a locked position in which the first engaging surface engages one of the opening edge and the doorframe so as to secure the door in the fully-closed position; and
wherein the closure element is arranged to engage the said one of the opening edge and the doorframe so as to move the door between the fully-closed position and the nearly-closed position as the closure element moves between the locked position and the unlocked position.

3. An automated collection point according to claim 1, wherein the closing mechanism is arranged to automatically move the door during both the first phase and the second phase.

4. An automated collection point according to claim 1, wherein the door is provided with a handle, and wherein the handle is arranged to retract when the door is locked and to extend when the door is unlocked.

5. An automated collection point including:
a plurality of lockers;
a local electronic controller; and
a local user interface cooperating with the controller;
each of the lockers having a door mounted in a doorframe;
the door having an opening edge which is displaced away from the doorframe when the door is moved to a fully-open position and lies adjacent the doorframe when the door is in a fully-closed position,
the opening edge having a length;
the door having a closing mechanism,
the closing mechanism being arranged to move the door from the fully-open position to a nearly-closed position;
wherein each locker includes an elongate closure element coupled to an actuator, the actuator being controlled by the controller;
the closure element having an elongate first engaging surface which extends in parallel with the opening edge of the door and substantially along the length thereof in the fully-closed position,
the closure element being movable by the actuator between an unlocked position in which the door is free to move, and a locked position in which the first engaging surface engages one of the opening edge and the doorframe so as to secure the door in the fully-closed position; and
wherein the closure element is arranged to engage the said one of the opening edge and the doorframe so as to move the door between the fully-closed position and the nearly-closed position as the closure element moves between the locked position and the unlocked position.

6. An automated collection point according to claim 5, wherein the closing mechanism is arranged to automatically move the door during both the first phase and the second phase.

7. An automated collection point according to claim 5,
wherein the closure element is mounted for rotation about an axis parallel with the first engaging surface.

8. An automated collection point according to claim 7, where the closure element includes a second engaging surface spaced apart from the first engaging surface,
wherein as the closure element moves between the locked position and the unlocked position, the said one of the opening edge and the doorframe is received between the first and second engaging surfaces, such that as the closure element is rotated in a first direction, the first engaging surface engages the said one of the opening edge and the doorframe so as to draw the door towards the fully-closed position, and
wherein as the closure element is rotated in a second, reverse direction, the second engaging surface engages the said one of the opening edge and the doorframe so as to urge the door towards the nearly-closed position.

9. An automated collection point according to claim 8, wherein the first and second engaging surfaces form two end faces of a wall which is curved about the axis of rotation of the closure element; and wherein the doorframe is attached to a fascia, and the curved wall slidingly abuts the fascia as the closure element rotates.

10. An automated collection point including:
a plurality of lockers;
a local electronic controller; and
a local user interface cooperating with the controller;
each of the lockers having a door mounted in a doorframe;
the door having an opening edge which is displaced away from the doorframe when the door is moved to a fully-open position and lies adjacent the doorframe when the door is in a fully-closed position;

the opening edge having a length;

the door having a closing mechanism;

the closing mechanism being arranged to move the door from the fully-open position to a nearly-closed position;

wherein each locker includes an elongate closure element coupled to an actuator, the actuator being controlled by the controller;

the closure element having an elongate first engaging surface which extends in parallel with the opening edge of the door and substantially along the length thereof in the fully-closed position;

the closure element being movable by the actuator between an unlocked position in which the door is free to move, and a locked position in which the first engaging surface engages one of the opening edge and the doorframe so as to secure the door in the fully-closed position; and wherein the closure element is arranged to engage the said one of the opening edge and the doorframe so as to move the door between the fully-closed position and the nearly-closed position as the closure element moves between the locked position and the unlocked position;

wherein the closure element includes a second engaging surface spaced apart from the first engaging surface, wherein as the closure element moves between the locked position and the unlocked position, the said one of the opening edge and the doorframe is received between the first and second engaging surfaces, such that as the closure element is rotated in a first direction about an axis parallel with the first engaging surface, the first engaging surface engages the said one of the opening edge and the doorframe so as to draw the door towards the fully-closed position, and wherein as the closure element is rotated in a second, reverse direction about the axis parallel with the first engaging surface, the second engaging surface engages the said one of the opening edge and the doorframe so as to urge the door towards the nearly-closed position.

11. An automated collection point according to claim 10, wherein the first and second engaging surfaces form two end faces of a wall which is curved about the axis of rotation of the closure element; and wherein the doorframe is attached to a fascia, and the curved wall slidingly abuts the fascia as the closure element rotates.

12. An automated collection point according to claim 10, wherein the closing mechanism is arranged to automatically move the door during both the first phase and the second phase.

* * * * *